US011721151B2

(12) United States Patent
Ericsson et al.

(10) Patent No.: US 11,721,151 B2
(45) Date of Patent: Aug. 8, 2023

(54) ACCESS RIGHT MANAGEMENT

(71) Applicant: KONE Corporation, Helsinki (FI)

(72) Inventors: Johan Ericsson, Helsinki (FI); Henry Silvennoinen, Helsinki (FI)

(73) Assignee: KONE Corporation, Helsinki (FI)

( * ) Notice: Subject to any disclaimer, the term of this patent is extended or adjusted under 35 U.S.C. 154(b) by 104 days.

(21) Appl. No.: 17/475,431

(22) Filed: Sep. 15, 2021

(65) Prior Publication Data

US 2022/0005301 A1 Jan. 6, 2022

Related U.S. Application Data

(63) Continuation of application No. PCT/FI2019/050288, filed on Apr. 9, 2019.

(51) Int. Cl.

| | |
|---|---|
| ***G07C 9/23*** | (2020.01) |
| ***G07C 9/27*** | (2020.01) |
| ***G07C 9/21*** | (2020.01) |

(52) U.S. Cl.

CPC ..... *G07C 9/23* (2020.01); *G07C 9/21* (2020.01); *G07C 9/27* (2020.01)

(58) Field of Classification Search

None

See application file for complete search history.

(56) References Cited

U.S. PATENT DOCUMENTS

| | | | | |
|---|---|---|---|---|
| 10,810,816 | B1 * | 10/2020 | Kocher | H04L 63/0853 |
| 11,663,867 | B2 * | 5/2023 | Outwater | B60L 53/68 340/5.6 |
| 2005/0242920 | A1 | 11/2005 | Bernosky et al. | |
| 2012/0068818 | A1 * | 3/2012 | Mizon | G07C 9/20 340/5.61 |
| 2017/0270725 | A1 | 9/2017 | Troesch et al. | |
| 2017/0324751 | A1 | 11/2017 | Prabhu | |
| 2019/0065724 | A1 * | 2/2019 | Dudley | G06F 21/35 |
| 2022/0005301 | A1 * | 1/2022 | Ericsson | G07C 9/23 |

FOREIGN PATENT DOCUMENTS

| | | | | |
|---|---|---|---|---|
| CA | 3043678 | A1 * | 5/2018 | G06Q 20/127 |
| CA | 3073197 | A1 * | 2/2019 | G06F 21/31 |
| CN | 106250959 | A | 12/2016 | |
| CN | 107004313 | A | 8/2017 | |
| EP | 0 722 241 | A2 | 7/1996 | |

OTHER PUBLICATIONS

English translation of Chinese Office Action and Search Report for Chinese Application No. 201980095254.7, dated Oct. 10, 2022.

International Search Report, issued in PCT/FI2019/050288, dated Dec. 16, 2019.

Written Opinion of the International Searching Authority, issued in PCT/FI2019/050288, dated Dec. 16, 2019.

* cited by examiner

*Primary Examiner* — Fekadeselassie Girma

(74) *Attorney, Agent, or Firm* — Birch, Stewart, Kolasch & Birch, LLP

(57) ABSTRACT

A method for controlling a generation of at least one access code includes receiving, in an access control device, data representing an access code; verifying the data representing the access code; in response to a detection in a verification that the access code is valid generating a signal causing a generation of data representing a new access code; and generating a signal causing a transmit of the data representing the new access code to a party from whom the data representing the access code is received. An access control device, a computer program product and a system are also disclosed.

20 Claims, 3 Drawing Sheets

ACCESS RIGHT MANAGEMENT

CROSS REFERENCE TO RELATED APPLICATIONS

This application is a Continuation of PCT International Application No. PCT/FI2019/050288, filed on Apr. 9, 2019, which is hereby expressly incorporated by reference into the present application.

TECHNICAL FIELD

The invention concerns in general the technical field of access control. More particularly, the invention concerns access right management for access control.

BACKGROUND

People flow management in buildings and in other similar places has gained attention due to security reasons among others. Traditional arrangement is that a security person sits in a lobby and checks access rights of persons entering the building, and e.g. provides a badge for identifying the person at least to some extent when the person roams in the building. Additionally, the building may be equipped with gates and doors which may be accessed with an applicable key, such as with a fob, shown to a reader.

Mobile devices, such as mobile phones, have provided a further possibility to manage access rights. For example, RFID feature of a mobile phone may be used for controlling the doors, the gates and the similar. The mobile devices are also suitable for receiving an access code, such as a QR code, which may be displayed to a reader for determining if the user has access to enter the building or similar. This kind of solutions are widely used at airport gates through which the passengers enter the airplanes.

A drawback in solutions based on QR codes is that the codes may be copied and/or forwarded to other devices, and may then be used, in at least some applications, by more than one person. This is true even though there is introduced solutions allowing so-called dynamic generation of QR codes. These are based on a delivery of code library to the mobile device which may generate codes locally. An example of this kind of approach is disclosed in a document CN 106250959 A.

SUMMARY

The following presents a simplified summary in order to provide basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

An object of the invention is to present a method, an access control device, a computer program product and a system for controlling a generation of an access. Another object of the invention is that the method, the access control device, the computer program product and the system allow a control of a generation of at least one access code.

The objects of the invention are reached by a method, an access control device, a computer program product and a system as defined by the respective independent claims.

According to a first aspect, a method for controlling a generation of at least one access code is provided, the method comprises: receiving, in an access control device, data representing an access code; verifying, by the access control device, the data representing the access code; and in response to a detection in a verification that the access code is valid generating, by the access control device, a signal causing a generation of data representing a new access code; and generating, by the access control device, a signal causing a transmit of the data representing the new access code to a party from whom the data representing the access code is received.

Moreover, the data representing the access code may be received, from a reader device, in response to an interaction between a terminal device of a user and the reader device communicatively coupled to the access control device.

The method may further comprise: generating, in response to the detection that the access code is valid, a signal causing an activation of an entity corresponding to the reader device from which the access code is received.

Alternatively or in addition, the generated data representing the new access code may be stored in data storage accessed for verifying access codes. For example, the generated data representing the new access code may be stored by replacing the data of the access code in the data storage.

The signal causing a generation of data representing a new access code may be generated from the access control device to an access code generator device.

Also, the data representing the new access code may be implemented as a link to a network address for obtaining the data from the network address by the terminal device.

The data representing the new access code may be transmitted to the terminal device through a reader device.

According to a second aspect, an access control device comprising: at least one processor and at least one memory including computer program code is provided; the at least one memory and the computer program code configured to, with the at least one processor, cause the access control device to perform: receive data representing an access code; verify the data representing the access code; and in response to a detection in a verification that the access code is valid the access control device: generate a signal causing a generation of data representing a new access code; and generate a signal causing a transmit of the data representing the new access code to a party from whom the data representing the access code is received.

Moreover, the access control device may be arranged to receive the data representing the access code from a reader device in response to an interaction between a terminal device of a user and the reader device communicatively coupled to the access control device.

The access control device may also comprise a functionality of the reader device.

Still further, the access control device may be arranged to: generate, in response to the detection that the access code is valid, a signal causing an activation of an entity corresponding to the reader device from which the access code is received.

The access control device may be arranged to cause storing of the generated data representing the new access code in data storage accessed for verifying access codes. For example, the access control device may be arranged to store the generated data representing the new access code by replacing the data of the access code in the data storage.

Furthermore, the access control device may be arranged to generate the signal causing a generation of data representing a new access code to an access code generator device.

According to a third aspect, a computer program product for controlling a generation of at least one access code is provided which computer program product, when executed by at least one processor, cause an access control device to perform the method as described above.

According to a fourth aspect, a system is provided, the system comprising: at least one reader device; an access code generator; and an access control device as described above.

The expression "a number of" refers herein to any positive integer starting from one, e.g. to one, two, or three.

The expression "a plurality of" refers herein to any positive integer starting from two, e.g. to two, three, or four.

Various exemplifying and non-limiting embodiments of the invention both as to constructions and to methods of operation, together with additional objects and advantages thereof, will be best understood from the following description of specific exemplifying and non-limiting embodiments when read in connection with the accompanying drawings.

The verbs "to comprise" and "to include" are used in this document as open limitations that neither exclude nor require the existence of unrecited features. The features recited in dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF FIGURES

The embodiments of the invention are illustrated by way of example, and not by way of limitation, in the figures of the accompanying drawings.

DESCRIPTION OF THE EXEMPLIFYING EMBODIMENTS

The specific examples provided in the description given below should not be construed as limiting the scope and/or the applicability of the appended claims. Lists and groups of examples provided in the description given below are not exhaustive unless otherwise explicitly stated.

Figure 1:
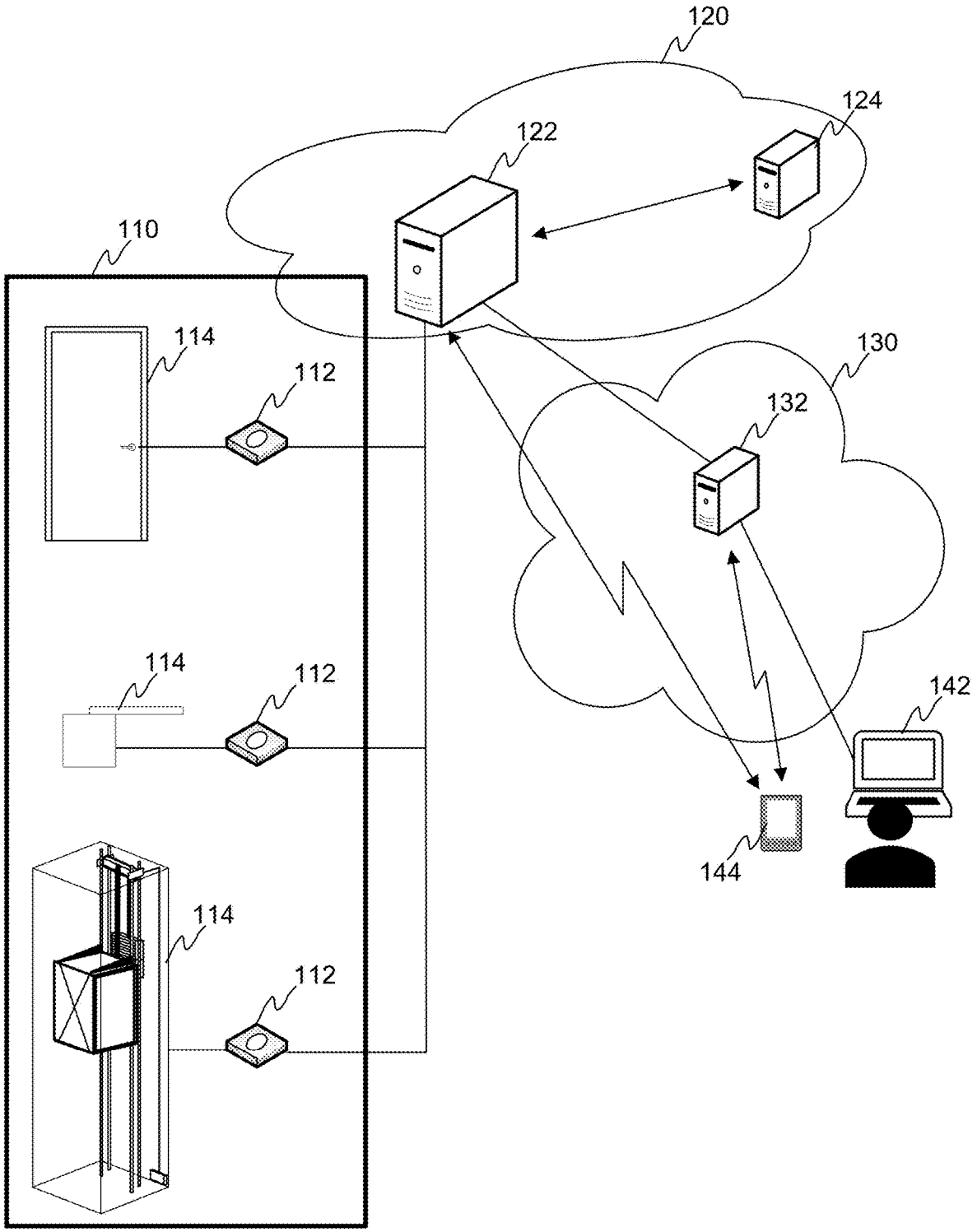
FIG. 1 illustrates schematically a non-limiting example of a system according to an embodiment of the invention.

FIG. 1 illustrates schematically a non-limiting example of a system according to an embodiment of the invention. The system may comprise one or more devices arranged in a building 110 for implementing an access control system. The access control system refers to devices and systems by means of which it is possible to arrange an access control in the building 110 at least in part. For example, the access control system may comprise reader devices 112 which may read, such as scan, object provided to an operational area of a reader device 112. Moreover, the access control system may comprise devices and systems whose operation is limited at least in part within the building 110, e.g. being behind one reader device 112. Such devices may e.g. be gates 114, doors 114, turnstiles 114 arranged in the building 110, but also systems, such as an elevator 114, or any other similar conveyor systems as non-limiting examples. Part of the access control system may reside external to the building 110 and perform a predetermined task for the access control system. For example, an access control device 122 may be arranged externally to the building 110 and to be communicatively coupled to the devices and systems residing in the building 110. The communication may be established by means of a wired or a wireless communication technology. Preferably, the communication is arranged in a secure manner e.g. applying encryption between the parties of the communication. For example, the access control device 122 may be arranged to control a use of a device, such as a door 114, a gate 114 or an elevator 114, residing in the building 110 in accordance with information received from at least one reader device 112. The control of the device may e.g. comprise a generation of a control signal to the device in question either directly or indirectly e.g. through the reader device 112. Still further, the access control system may comprise a functionality of an access code generator, which is illustrated as a computing device 124 in FIG. 1. The functionality may also be arranged in the access control device 122. Depending on an implementation one or more entities belonging to the access control system may reside in a dedicated network 120, such as in a virtual private network for implementing tasks as will be described. In some embodiment of the invention the access control device 122, and the computing device 124 if applicable, may reside in the building 110 wherein the dedicated network may be arranged.

As mentioned, the access control device 122 may reside externally to the building 110 for which it provides services regarding to the access controlling. Naturally, the access control device 122 may reside in the building and arranged to be communicatively to other entities external to the building e.g. by utilizing so-called cloud computing environment. In case the access control device 122 resides in the building further devices, such as a reader device 112, may be integrated to the access control device 122.

Generally speaking at least some embodiments of the present invention relate to an arrangement in which a person intending to visit the building 110 may be requested to provide at least some information with respect to the visit. This may e.g. be arranged so that a person, or a host, inviting the person to visit the building 110 may generate an invitation which may be delivered to the person with any communication method. The communication method may e.g. be email, short message or any other message deliverable with any messaging application, or even a chat message over a chat application implementing a chat session between the host and the person. The invitation may comprise a link addressing to a network node 132, such as a server device residing in a communication network 130, like Internet, in which it may be maintained a website into which the person may input at least some information relating to the visit. In other words, the person may enter the website by activating the link e.g. by clicking it e.g. with an input device of a computing device 142, such as a laptop, by means of which the person may access the invitation message. As mentioned, the person may input information relating to the visit as requested on the website. The requested information may e.g. comprise personal data with respect to person, such as name and any other identification data, or anything similar. In some embodiment of the invention, the webpage may be protected in some manner. The webpage may e.g. request user credentials provided to the person prior to displaying the form into which the requested information may be input. The network node 132 maintaining the webpage may be arranged to deliver the input data by the person to the access control device 122 and request an access code needed for accessing the building in question. The access control device 122 may obtain the access code e.g. by retrieving it from a memory accessible by the access control device 122 or requesting the access code from an access code generator i.e. from a computing device 124 if such is arranged in the system for generating the access codes. In response to a receipt of the generated access code the access control device 122 may be arranged to deliver the access code to a terminal device 144 of the person who provided the information for the visit. The delivery of the access code may be arranged so that the access control device 122 delivers it directly to the terminal device 144 or indirectly through the network node 132, e.g. by including the access code data on the web page. According to another embodiment of the invention the access control device 122 may be arranged to operate so that it obtains one or more access codes as described and delivers them to the network node 132 in advance so that they may be delivered if requested. According to an embodiment of the invention the access code may be delivered to the network node 132 and/or to the terminal device 144 in a form of a network address link which, when activated in any known manner, may connect the terminal device 144 possessing the link to the network address defined by the link. The network address may e.g. direct the communication to the access control device 122 which provides an access to the data stored behind the link in response the link is activated. This may e.g. cause the terminal device 144 to display the data i.e. the access code on a display of the terminal device 144, for example. Still further, in some embodiment the access control device 122 and the network node 132 may be the same entity accessible by an applicable device possessed by the person in question. In the description above, and in FIG. 1, the person may use the computing device 142 and the terminal device 144 for accessing the access code as described. Especially, the access code may be accessible by the terminal device 144 the person carries with him/her when visiting the building 110. For sake of clarity it is worthwhile to mention that the terminal device 144 and the computing device 142 may be the same device. In the following the term "terminal device" refers to any device the person may carry with him/her when visiting the building and the terminal device is referred with a reference number 144.

The generated access code expressed may be in any form applicable to be used in the access control system. For example, the access code may e.g. be expressed as a visual code, such as a barcode or as a matrix barcode, like QR (Quick Response) code. Any similar visual code type may be used. According to some other embodiment, the access code may be expressed as another form of code, such as an audio code. The reader devices 112 of the access control system are selected in accordance with the access code type used in the system.

Moreover, the terminal device 144 may be arranged to execute an application for access code management. The application may be a web browser which is arranged to open the generated access code from a web address defined by a network address link accessible to the person by means of the terminal device 144. Alternatively, the application may be a dedicated application installed to the terminal device 144 which is arranged to be involved in the management of the access codes at least in part. For example, the application may be developed by a party managing the visits in the building and the visitors may download and install the application in the terminal device 144 if planning to visit the building. The person may e.g. set up the visit to the building 110, i.e. providing necessary information, by means of the application, as well as obtain the access code to the terminal device 144. Additionally, the application may be arranged to perform at least some further steps of a method according to an embodiment of the invention as is described. Still further, the management of the access codes may be arranged with any other application which is suitable for performing the tasks necessary for managing the access codes.

Now, the person enters the building 110 at some point of time e.g. for meeting the host and carries the terminal device 144 by means of which the person may access the generated access code. The person may e.g. take necessary actions to access the code and output it in a manner specific to the access code and the reader device in question 112. For example, the person may stand in front of a door of the building 110 where it is installed a reader device 112 for obtaining the access code data from a terminal device 144 of the person desiring to access the building 110. Hence, the person takes the terminal device 144 outputting the access code, such as the QR code, in an operational vicinity of the reader device 112 and the reader device reads, such as scans, the access code output. The reader device 112 may be arranged to deliver the obtained data representing the access code to the access control device 122 for further analysis.

In response to a receipt of the obtained data representing the access code from the reader device 112 the access control device 122 may be arranged to verify the received data representing the access code. A verification may refer to a procedure in which the access control device 122 is arranged to verify if the data representing the access code corresponds to a comparison data accessible to the access control device 122. The comparison data may be stored in data storage arranged to store access code data generated by the access control system, such as the access control device 122. The comparison data may comprise further data, such as an identifier, indicating to whom the comparison data, i.e. a generated access code, is delivered. Corresponding data may be received together with the data received from a reader device 112, for example, which may be derived from the received data and an inquiry to data storage storing generated access codes may be performed by means of the data in question, such as with the identifier. Hence, an outcome of the verification of the received data representing the access code from the reader device 112 may be that the access code is valid, or it is invalid.

In case of it is verified that the access code is valid it may cause the access control device 122 to generate a signal causing a generation of data representing a new access code. In other words, the access control device 122 is arranged to generate a new access code. The generation of the data representing the new access code may refer to a signaling requesting a new access code from an access code generator i.e. from a computing device 124 if such is arranged in the system for generating the access codes. The generation shall also be understood to cover an implementation in which the access control device 122 is arranged to obtain a new access code from data storage storing a number of generated access codes. Still further, the access control device 122 may be arranged to generate a signal causing storing of data representing the new access code in data storage accessed, i.e. used, for verifying access codes as described above in response to the generation of the access code. The storing may be arranged either so that the new access code is stored as a new data item in the memory or it may be arranged the data representing the new access code is arranged to replace the data of the used access code. The latter option improves a memory management in the access control system.

In order to deliver the generated new access code to a terminal device 144 of the person visiting the building 110 the access control device 122 may also be arranged to generate a signal causing a transmit of the data representing the new access code to the party from whom the data representing the access code is received. Here, the access control device 122 may be arranged to obtain a network address of the recipient, i.e. the person or his/her terminal device 144 in one way or other. For example, in case an identifier is received together with the verified access code it may be used in the transmit of the data representing the new access code especially in a case it represents directly or indirectly the network address of the recipient. Alternatively or in addition, the access control device 122 may be arranged to obtain the network address of the terminal device 144 from data storage arranged to store it e.g. together with the first access code data.

An access to the data representing to the new access code may be provided to the terminal device 144 in a same manner as already described. For example, it may be delivered to the terminal device 144 or alternatively a link addressing to a network node storing the data may be provided to the terminal device 144. Now, when the person roams in the building 110 and meets another reader device 112 controlling at least in part another entity, such as a gate, a door or an elevator, he/she may provide the new access code to the reader device 112. The procedure as described may be repeated in response to use of the new access code.

According to an embodiment of the invention the generated new access code may be transmit to the party through a reader device 112. This may be arranged so that in response to the generation of the new access code the data is transmit by the access control device 112 to a reader having interaction with the terminal device 144 from which the first access code is received. In this kind of implementation, the reader device 112 may perform bi-directional communication with the terminal device 144 and share the new access code to the terminal device 144 e.g. with a short-range communication technology, like Bluetooth.

In addition to the above given description the access control device 122 may be arranged to generate a signal, in response to the verification that the access code is valid, causing a right to access through a gate or a door, or to utilize a system the reader device 112 is arranged to control at least in part together with other elements of the access control system. In other words, the access control device 122 may generate a control signal to the entity in question in response to a detection in the verification that the access code is valid for enabling the person to use the entity in question (e.g. pass the gate or the door or use the elevator system as non-limiting examples). The generation of the control signal to the entity in question may cause an activation of the entity corresponding to the reader device 112 from which the access code is received, the activation allowing the person in question to use the entity in question, such as pass the gate or use the elevator, for example.

Figure 2:
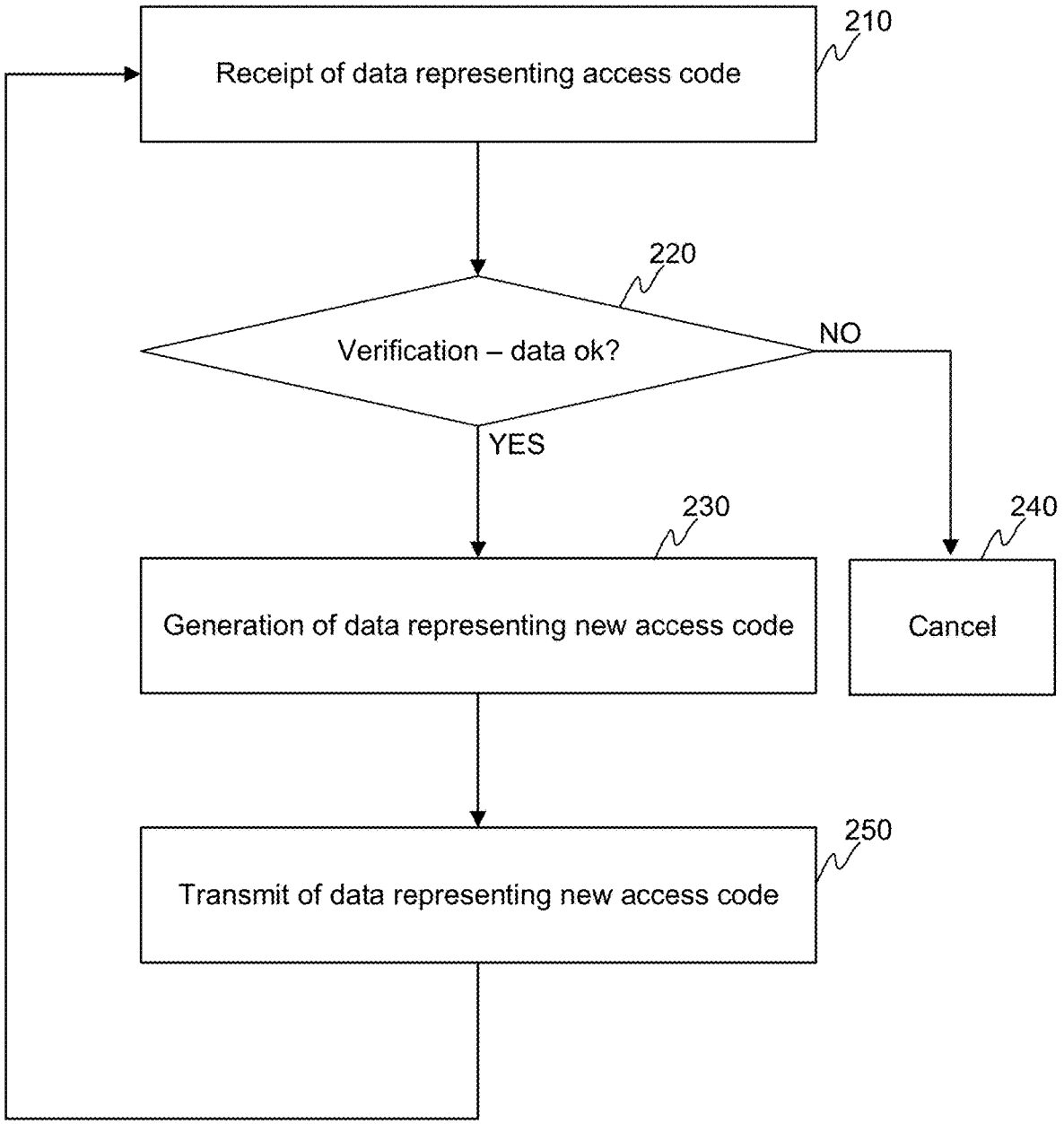
FIG. 2 illustrates schematically a non-limiting example of a method according to an embodiment of the invention.

FIG. 2 illustrates schematically a non-limiting example of a method according to an embodiment of the invention as a flow chart. The method may relate to a control of a generation of one or more access codes to be used in an access control system as described. The method as described in FIG. 2 illustrates at least some portion of the procedure according to an embodiment of the invention from a point of the access control device 122. The access control device 122 may perform further steps, such as generating data representing an access code and delivering it to a terminal device 144, e.g. prior to phases as schematically illustrated in FIG. 2. The method according to an embodiment of the invention may be the following:

Phase 210:

The access control device 122 may receive data representing an access code. The data may be received directly or indirectly from a reader device 112 e.g. in response to an interaction between a terminal device 144 of a user (e.g. a person visiting a building) and the reader device 112 communicatively coupled to the access control device.

Phase 220:

The access control device 122 may be arranged to verify the data representing the access code. The verification refers to an operation in which it may be determined if the received data is valid and authorizes a person to use a device or a system as already described in the context of FIG. 1.

Phases 230 and 240:

In response to a detection in the verification 220 that the access code is valid the access control device 122 may be arranged to generate a signal causing a generation of data representing a new access code 230. The generation of the new data may comprise communication between the access control device 122 and one or more other entities, or even internally by the access control device 122. For example, the access control device 122 may request another computing device 124 to generate the new access code and receive it as the response. One of the entities may also store the data representing the new access code to data storage, for example. Alternatively, the access control device 122 may be arranged to request the new access code from data storage storing generated access codes.

On the other hand, if the verification indicates that the access code under verification is invalid in one way or another, such as the access control device 122 is not able to find a comparison data corresponding to the received access code data, the operation may be cancelled 240. The cancellation 244 of the operation may e.g. correspond to a situation that the access control device 122 does not take any measures to continue the process.

Phase 250:

Next, the access control device 122 may be arranged to transmit the data representing the new access code to a recipient by generating 250 a signal causing the transmit. The recipient advantageously refers to the party from whom the data representing the access code in step 210 is received. The access control device 122 may be arranged to determine a communication address, such as a network address, of the party e.g. from data received in step 210, or some other way as already discussed.

The procedure as described in FIG. 2 may be continued in the same manner in response to a receipt of data representing an access code, or in response to a receipt of any data, by the access control device 122.

The method as schematically depicted in FIG. 2, and its corresponding description above, shall be understood to cover some aspects of the method. Other aspects, such as the ones brought out in the description of FIG. 1, may also be applicable with the aspects as disclosed in the description of FIG. 2.

Figure 3:
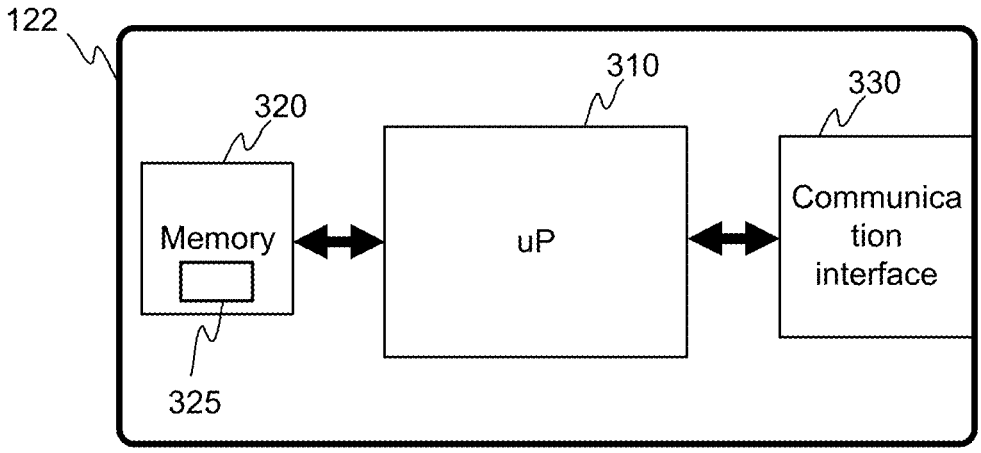
FIG. 3 illustrates schematically a non-limiting example of an access control device according to an embodiment of the invention.

FIG. 3 schematically illustrates an example of an access control device 122 according to an embodiment of the invention. The access control device 122 may at least be arranged to receive data from one or more reader devices 112 as well as to communicate with other entities either directly or indirectly and process the received data to perform the method as described. The access control device 122 may comprise one or more processors 310, one or more memories 320 and one or more communication interfaces 330 which entities may be communicatively coupled to each other with e.g. a data bus. The communication interface 330 may comprise necessary hardware and software for coupling the access control device 122 communicatively to the mentioned entities. The communication interface 330 may be arranged to implement either wired or wireless communication protocol or even both and has necessary hardware thereto. Further, the operation of the access control device 122 in the manner as described may be at least partly controlled by the one or more processors 310 e.g. by executing portions of computer program code 325 stored in the one or more memories 320. In other words, the computer program code 325 may define instructions that cause the access control device 122 to operate as described when at least one portion of the computer program code 325 is executed by the processor(s) 310. The access control device 122 as schematically illustrated in FIG. 3 does not comprise all elements of the access control device 122. For example, the power related elements needed for bringing the access control device 122 into operation are not shown in FIG. 3. Even if the access control device 122 is schematically illustrated as a stand-alone device in FIG. 3, the implementation of it, and its functionalities, may be arranged in a distributed manner between a plurality of computing device arranged to implement the operation in cooperation with each other.

Depending on the implementation of the present invention the access control device 122 may also be arranged to implement functionalities of other entities, such as a computing device 124 arranged to generate access codes, for example. As already mentioned at least part of functionalities of the access control device 122 may be integrated with other devices, such as reader devices 112. All in all, at least some of the functionalities of the entities described herein may be implemented in a distributed manner wherein a plurality of processed executed by a plurality of devices produce the functionality in question.

Some aspects of the present invention may relate to a computer program product for controlling a generation of at least one access code. The computer program product, stored e.g. on a non-transitory computer readable medium, may, when executed by at least one processor, cause a computing device, such as an access control device 122, to perform the method as described.

Still further, some aspects of the present invention may relate to a system at least comprising: at least one reader device 112, an access code generator 124, and an access control device 122. The access control device 122 may be arranged to perform the method as described e.g. by receiving data representing an access code from the at least one reader device 112 and by requesting a generation of data representing a new access code with a signal to the access code generator 124. As mentioned, in some embodiment of the system at least one of the following: the at least one reader device 112, the access code generator 124 may be integrated with the access control device.

The specific examples provided in the description given above should not be construed as limiting the applicability and/or the interpretation of the appended claims. Lists and groups of examples provided in the description given above are not exhaustive unless otherwise explicitly stated.

What is claimed is:

1. A method for controlling a generation of at least one access code, the method comprising:

generating, by the access control device, a signal causing a generation of data representing an access code, in response to a party requesting the access code and providing credentials;

delivering the access code to said party;

receiving, in the access control device, data representing said access code;

verifying, by the access control device, the data representing the access code; and in response to a detection in a verification that the access code is valid:

generating, by the access control device, a signal causing a generation of data representing a new access code; and generating, by the access control device, a signal causing a transmit of the data representing the new access code to the party from whom the data representing the access code is received.

2. The method of claim 1, wherein the data representing the access code is received, from a reader device, in response to an interaction between a terminal device of a user and the reader device communicatively coupled to the access control device.

3. The method of claim 1, the method further comprising:

generating, in response to the detection that the access code is valid, a signal causing an activation of an entity corresponding to the reader device from which the access code is received.

4. The method of claim 1, wherein the generated data representing the new access code is stored in data storage accessed for verifying access codes.

5. The method of claim 4, wherein the generated data representing the new access code is stored by replacing the data of the access code in the data storage.

6. The method of claim 1, wherein the signal causing a generation of data representing a new access code is generated from the access control device to an access code generator device.

7. The method of claim 1, wherein the data representing the new access code is implemented as a link to a network address for obtaining the data from the network address by the terminal device.

8. The method of claim 1, wherein the data representing the new access code is transmitted to the terminal device through a reader device.

9. An access control device comprising:

at least one processor; and at least one memory including computer program code;

wherein the at least one memory and the computer program code are configured to, with the at least one processor, cause the access control device to:

generate a signal causing a generation of data representing an access code, in response to a party requesting the access code and providing credentials;

deliver the access code to said party;

receive data representing the access code;

verify the data representing the access code; and in response to a detection in a verification that the access code is valid the access control device:

generate a signal causing a generation of data representing a new access code; and generate a signal causing a transmit of the data representing the new access code to the party from whom the data representing the access code is received.

10. The access control device of claim 9, wherein the access control device is arranged to receive the data representing the access code from a reader device in response to an interaction between a terminal device of a user and the reader device communicatively coupled to the access control device.

11. The access control device of claim 9, wherein the access control device comprises a functionality of the reader device.

12. The access control device of claim 9, wherein the access control device is arranged to:

generate, in response to the detection that the access code is valid, a signal causing an activation of an entity corresponding to the reader device from which the access code is received.

13. The access control device of claim 9, wherein the access control device is arranged to cause storing of the generated data representing the new access code in data storage accessed for verifying access codes.

14. The access control device of claim 13, wherein the access control device is arranged to store the generated data representing the new access code by replacing the data of the access code in the data storage.

15. The access control device of claim 9, wherein the access control device is arranged to generate the signal causing a generation of data representing a new access code to an access code generator device.

16. A computer program product comprising a non-transitory computer readable medium for controlling a generation of at least one access code which, when executed by at least one processor, cause an access control device to perform the method according to claim 1.

17. A system, comprising:

at least one reader device;

an access code generator; and the access control device according to claim 9.

18. The method of claim 2, the method further comprising:

generating, in response to the detection that the access code is valid, a signal causing an activation of an entity corresponding to the reader device from which the access code is received.

19. The method of claim 2, wherein the generated data representing the new access code is stored in data storage accessed for verifying access codes.

20. The method of claim 3, wherein the generated data representing the new access code is stored in data storage accessed for verifying access codes.

* * * * *